US009670020B2

(12) United States Patent
Morelli et al.

(10) Patent No.: US 9,670,020 B2
(45) Date of Patent: Jun. 6, 2017

(54) REEL UNWINDER AND UNWINDING METHOD

(71) Applicant: FABIO PERINI S.P.A., Lucca (IT)

(72) Inventors: Roberto Morelli, S. Maria a Colle (IT); Angelo Benvenuti, Lucca (IT)

(73) Assignee: Fabio Perini Packaging S.p.A., Lucca (IT)

( * ) Notice: Subject to any disclaimer, the term of this patent is extended or adjusted under 35 U.S.C. 154(b) by 381 days.

(21) Appl. No.: 14/359,831

(22) PCT Filed: Nov. 15, 2012

(86) PCT No.: PCT/EP2012/072793

§ 371 (c)(1),
(2) Date: May 21, 2014

(87) PCT Pub. No.: WO2013/076011

PCT Pub. Date: May 30, 2013

(65) Prior Publication Data

US 2014/0326822 A1 Nov. 6, 2014

(30) Foreign Application Priority Data

Nov. 23, 2011 (IT) ..... FI2011A0253

(51) Int. Cl.
*B65H 16/10* (2006.01)
*B65H 19/18* (2006.01)
*B65H 19/12* (2006.01)

(52) U.S. Cl.
CPC ..... *B65H 16/106* (2013.01); *B65H 19/12* (2013.01); *B65H 19/18* (2013.01);
(Continued)

(58) Field of Classification Search
CPC ..... B65H 19/126; B65H 2301/4132; B65H 2301/41346; B65H 2301/41394;
(Continued)

(56) References Cited

U.S. PATENT DOCUMENTS 3,813,052 A * 5/1974 Swann ..... B65H 19/1821 242/420.3
4,729,522 A * 3/1988 Tafel ..... B65H 19/1821 242/418.1

(Continued)

FOREIGN PATENT DOCUMENTS

EP 0509595 A1 10/1992
GB 2183224 A 6/1987

(Continued)

*Primary Examiner* — William A Rivera
(74) *Attorney, Agent, or Firm* — Breiner & Breiner, L.L.C.

(57) ABSTRACT

A reel unwinder including a first unwinding position, in which a first reel is positioned; a second unwinding position, to which the first reel is transferred when it is replaced with a second reel; a stand-by position, in which the second reel is kept in stand-by; a first unwinding member adapted to start rotation of the second reel when the first reel is replaced with the second reel. Moreover, the unwinder includes a second unwinding member, with at least one endless flexible element. The endless flexible element extends from the first unwinding position to the second unwinding position, and is adapted to maintain the first reel in contact with the second unwinding member and in rotation by the second unwinding member in the first unwinding position, in the second unwinding position and while it is being transferred from the first unwinding position to the second unwinding position.

22 Claims, 10 Drawing Sheets

(52) U.S. Cl.
CPC ..... *B65H 2301/41361* (2013.01); *B65H 2301/413526* (2013.01); *B65H 2301/46* (2013.01)

(58) Field of Classification Search
CPC .. B65H 2301/41468; B65H 2301/4185; B65H 2405/04; B65H 16/106; B65H 19/18; B65H 19/12
USPC ..... 242/535.4, 541.3, 555.7, 564.5
See application file for complete search history.

(56) References Cited

U.S. PATENT DOCUMENTS

| | | | | |
|---|---|---|---|---|
| 4,875,633 | A * | 10/1989 | Mochizuki | B65H 19/1889 242/554.2 |
| 6,817,566 | B2 * | 11/2004 | Clifford | B65H 19/14 156/564 |
| 7,350,740 | B2 * | 4/2008 | Benvenuti | B65H 19/126 242/555.1 |
| 7,458,538 | B2 * | 12/2008 | Betti | B65H 16/10 242/420.1 |
| 7,500,634 | B2 * | 3/2009 | Benvenuti | B65H 19/1836 242/552 |
| 7,980,504 | B2 * | 7/2011 | Butterworth | B65H 19/1847 242/554 |
| 2002/0060266 | A1 | 5/2002 | Lintelmann et al. | |
| 2004/0118964 | A1 | 6/2004 | Long | |

FOREIGN PATENT DOCUMENTS

| | | | |
|---|---|---|---|
| GB | 2204026 | A | 11/1988 |
| WO | 03042083 | A1 | 5/2003 |
| WO | 2006077609 | A2 | 7/2006 |
| WO | 2007099570 | A1 | 9/2007 |
| WO | 2010121252 | A2 | 10/2010 |

* cited by examiner

VII
VII
IA 9B
9
7
9D
A
5
3
27
11D
11B
41=39
40
11
7C
7A
7R
AS
f27
33
38
7T
71
7X
N1
B1
42

REEL UNWINDER AND UNWINDING METHOD

TECHNICAL FIELD

The present invention relates to machines for converting or processing web material wound in logs or reels. More in particular, the present invention relates to improvements to methods and to devices for unwinding reels of web material, in particular, but not exclusively, reels of cellulose material, such as paper, "tissue" paper and the like, and for feeding said web material to one or more processing stations downstream of the unwinder.

STATE OF THE ART

In the paper manufacturing field, for example for the manufacture of articles made of tissue paper, such as toilet paper, kitchen towel or the like, it is customary to produce reels of large diameter by means of winding one or more plies of cellulose material. These reels of large diameter are subsequently unwound by means of unwinders to feed the web material to processing and converting stations, for the production of logs of smaller diameter or other products, in particular semi-finished products intended for subsequent processing to obtain finished products intended for sale, such as rolls of toilet tissue, rolls of kitchen towel, paper napkins or the like.

Unwinders must be designed in such a manner as to allow rapid replacement of an empty reel with a new reel which is kept in a stand-by position. U.S. Pat. No. 7,350,740 and U.S. Pat. No. 7,500,634 describe unwinders that perform replacement of an empty reel with a new reel automatically and without stopping the feed of the web material.

WO2006/077609 describes an unwinder, in which an empty reel is moved by means of a pair of guides from an unwinding position to an unloading position. Once the reel has been transferred from one to the other of the two above-mentioned positions, a new reel is lowered from above toward the unwinding station until it comes into contact with unwinding belts below. The movement of the unwinder is stopped before the empty-reel replacement step. Once the new reel has been positioned, the unwinder is restarted. In this case, to ensure continuous feed of the web material downstream it is necessary to provide a "festoon", i.e. a supply of web material formed between series of guide rollers with a center distance that can be varied to allow delivery of web material downstream of the festoon when there is no feed of web material upstream of said festoon.

A similar unwinder is described in WO2007/099570.

WO2010/121252 describes an unwinder in which there is provided an unwinding position of a reel and a stand-by position for a new reel. When the reel being unwound is empty, the web material is severed and the tail end of the web material is wound on a suction roller. The empty reel is removed from the unwinding position and replaced with a new reel, which until that moment was retained in the stand-by position. The roller on which the tail of the cut web material has been wound is moved toward the new reel to perform splicing of the web material wound on the new reel with the web material wound on the roller. Once splicing of the two web materials has been performed, feed toward the downstream stations can start up again. Also in this prior art unwinder, a festoon accumulator must be provided to ensure continuous delivery to the production line downstream of the unwinder. This is also necessary in order to wind on the suction roller an adequate length of the web material coming from the first empty reel.

EP-1444154 describes an unwinder in which, to perform automatic replacement of an empty reel with a new reel standing by, three distinct unwinding members are provided. A first main unwinding member comprises central unwinding systems, i.e. systems which engage the reel of web material at the axis thereof and draw it in rotation. This first unwinding member performs the majority of the unwinding cycle of each reel. At the side of the unwinding position there is provided a stand-by position for a second reel intended to replace the first reel, when this latter is empty. To perform replacement of the reel being unwound with a reel standing by, the unwinding member is transferred together with the reel being unwound from the main unwinding position toward an auxiliary unwinding position below. Here a second unwinding member is located which, coming into contact with the reel being unwound, maintains the latter in rotation and is responsible for performing the final part of the unwinding cycle. The first unwinding member can therefore be returned to the main unwinding position to receive the reel standing by, while the second unwinding member continues to maintain the reel in rotation and to deliver the web material. The reel standing by is placed in rotation with a third unwinding member. Starting unwinding of the reel standing by, the head end of this latter is laid on the final part of the web material still being unwound from the first reel, which is temporarily in a lower position and is unwound by the second unwinding member. In this way the two web materials coming from the two reels are superimposed and fed together to splicing means positioned downstream. Once the head end of the new reel reaches the splicing means, splicing is performed between the web material unwound from the first reel and the web material unwound from the second reel, so that the empty reel can be removed by cutting the remaining web material and the new reel previously standing by starts its actual unwinding cycle.

These prior art unwinders have some problems. In some cases these machines are particularly complex, difficult to manage and have high manufacturing costs. Some of them are unable to perform replacement of the reels without stopping the feed of web material and therefore require a festoon accumulator which increases the cost of the machine, its susceptibility to breakages and also the space necessary for installation of the machine, with consequent increase in the areas required for the converting line, of which the unwinder forms the first block.

In general, prior art unwinders can unwind the reels only in one direction.

Moreover, many prior art unwinders use glue or adhesive tape to perform splicing of the two plies coming from the almost empty reel and from the new reel. This involves the need for consumables and relatively long preparation times. Moreover, the adhesive material used in the splicing area, which is discarded and subsequently recycled, pollutes the cellulose material, which must therefore be suitably treated before being recycled.

SUMMARY OF THE INVENTION

According to one aspect, the invention provides a reel unwinder, in particular for reels of cellulose material, such as parent reels or reels of large diameter coming from a paper mill, to feed paper converting lines, such as lines for manufacturing logs, rolls, napkins or the like, which completely or partly overcomes the problems of prior art machines and devices.

Substantially, according to one embodiment an unwinder for unwinding reels of web material is provided, comprising: a first unwinding position, in which a first reel is positioned during at least a part of an unwinding cycle; a second unwinding position, to which said first reel is transferred when it must be replaced with a second reel; a stand-by position, in which said second reel is kept in stand by; a first unwinding member associated with said stand-by position, arranged and controlled to start rotation of said second reel when the first reel must be replaced with the second reel. Moreover, the unwinder comprises a second unwinding member which has at least one endless flexible element. Advantageously, the endless flexible element of the second unwinding member extends from the first unwinding position to the second unwinding position, and is arranged and controlled iso that the first reel is maintained in contact with said second unwinding member and in rotation by means of said second unwinding member in the first unwinding position, in the second unwinding position and while it is being transferred from said first unwinding position to the second unwinding position.

As will be apparent from the description hereinafter, in this way the unwinder can perform replacement of an almost empty reel with a new reel, previously arranged in a stand-by position, without requiring to stop the feed of web material, and therefore without any festoon accumulator or magazine or the like. Alternatively, accumulators can be provided which have a dimension smaller than those required in systems in which replacement of the two reels takes place by stopping the unwinding.

Continuous unwinding without the need to stop rotation of the reels can take place employing only two unwinding members, with considerable simplification with respect to prior art unwinding systems with automatic splicing. Further advantages of embodiments of the invention will be illustrated hereinafter and will be clear from the description of the drawings, which show a non-limiting embodiment of the invention.

In advantageous embodiments, the stand-by position is above the first unwinding position, i.e. the stand-by position is at a greater height, more or less at the first unwinding position. Transfer of a reel from one to the other of said positions can therefore take place with a particularly simple transfer device, for example formed by a pivoting arm or a pair of pivoting arms.

In some embodiments, the first unwinding position is located between the second unwinding position and an outlet of the web material from the unwinder. A splicing device can be arranged in the web material. In some particularly advantageous embodiments, the splicing device is a mechanical device, wherein one or more pressure wheels act against one or more counter-rollers. The web material of the two reels passes between wheels and counter-rollers and the two materials are joined by the effect of localized pressure exerted on the fibers (effect known as "intermingling").

Advantageously, the second unwinding member can be arranged and controlled to modify the path of the endless flexible element as a function of the position of the first reel with respect to the first unwinding position and to the second unwinding position. Typically, it can be provided that the endless flexible element is guided around a plurality of guide rollers, at least one of which has a movable axis to modify the path of the endless flexible element, and at least one of which is motorized. If necessary, a further guide roller can be movable for recovering slackening of the endless flexible element caused by the gradual decrease in the diameter of the reel being unwound.

The roller with movable axis provided to modify the path of the endless flexible element can be arranged and controlled in such a manner as to move from a lower position to an upper position. When the roller is located at the upper position, the endless flexible element is positioned so as to act on a reel located in the second unwinding position. When the roller is located in the lower position, the position of the endless flexible element is such as to allow transfer of the empty reel from the second unwinding position toward an unloading position, without interfering with the second unwinding member. Moreover, when the movable roller is located in the lower position, the reel that is located in the second unwinding position stops being drawn in rotation.

In practical embodiments the endless flexible element extends from the first unwinding position to the second unwinding position and has an active branch that moves from said first unwinding position toward said second unwinding position or vice versa according to the direction of rotation of the first reel.

In some embodiments, the endless flexible element extends between the second unwinding position and the splicing device to splice the web material unwound from the first reel and the web material unwound from the second reel, the first unwinding position being located between the second unwinding position and said splicing device.

In advantageous embodiments, tailstocks can be provided in the first unwinding position, which are controlled and arranged to axially engage the first reel and to release the first reel to allow movement thereof toward the second unwinding position. In other embodiments other systems can be provided to retain the reel in the first unwinding position, for example rollers to engage the ends of the winding rod.

The transfer device that transfers the reels from the stand-by position to the first unwinding position can be provided with pivoting arms with seats formed by movable portions carried by said pivoting arms. The seats can be provided with idle wheels or other members that allow rotation of the reel about its axis under the action of the first unwinding member, while the same reel is engaged in the aforesaid seat.

A transfer member can be provided to transfer the reels from the first unwinding position to the second unwinding position. The transfer member can comprise a carriage, or a pair of carriages, movable along respective guides extending between the two unwinding positions. In advantageous embodiments the same transfer member is also arranged and designed to be movable from the second unwinding position to an unloading position in which the empty reel is released.

To sever the web material coming from the almost empty reel, a cutting member can be provided, controlled and arranged to cut the web material of said first reel at the end of unwinding. In this way, it is possible to stop unwinding, even before all the web material has been unwound. This is particularly useful to discard the first turns, i.e. the innermost turns, of each reel, which are normally wrinkled or damaged and cannot be used for production. The cutting member can comprise a smooth, or preferably serrated mechanical blade. Other cutting systems, for example laser, water, compressed air cutting tools, or the like, could also be used.

The cutting member is preferably associated with the second unwinding position, although other configurations are possible, for example in the unloading position, or in an intermediate position, or on the transfer member.

Preferably, both the first unwinding member and the second unwinding member are peripheral unwinding members. By also designing the first unwinding member as a peripheral unwinding member, i.e. comprising one or more belts, webs, mats or other endless elements, the transfer of the reel in the first unwinding position and passage of control from the first unwinding member to the second unwinding member and engagement of the reel by idle tailstocks positioned in the first unwinding position, are simplified.

Advantageously, an unwinder according to the invention can be controlled to unwind the reel in one direction or in the opposite direction. This is particularly useful and advantageous considering the following. The ply of cellulose material coming from the continuous forming machine usually has two opposite surfaces which have different roughnesses to one another. In particular, when the cellulose material is treated with a Yankee cylinder, the surface of the ply in contact with the Yankee cylinder is smoother than the opposite surface. To obtain a multi-ply product of better quality, two plies are preferably combined to one another in such a manner that the smooth surface of each ply is facing the outside of the finished product. This requires the two reels to be unwound in opposite directions. The use of an unwinder that allows unwinding in one direction or in the other simplifies the layout and the management of the plant.

In some embodiments of the invention the unwinder uses a system of splicing the plies by means of mechanical ply-bonding. This allows splicing of the plies without the use of glue or double-sided adhesive tapes, eliminating consumables and pollutants and simplifying the operations for preparation of the new reel standing by.

According to a further aspect, the invention relates to a method for unwinding reels of web material and performing splicing between a tail of a first web material unwound from a first reel and a head of a second web material unwound from a second reel without stopping the feed of web material, comprising the steps of:

positioning said first reel in a first unwinding position;

positioning the second reel in a stand-by position, in which a first unwinding member is arranged;

unwinding the first web material from said first reel by means of a second unwinding member;

before unwinding of the first reel is terminated, transferring said first reel from the first unwinding position toward a second unwinding position, maintaining said first reel in rotation by means of said second unwinding member and continuing to unwind said first web material;

placing the second reel in rotation and transferring the second reel from the stand-by position toward the first unwinding position while the second web material starts to unwind from the second reel;

splicing the head of the second web material to the tail of the first web material.

According to advantageous embodiments of the method of the present invention, the head of the second web material is placed on the first web material, while said first web material continues to unwind from the first reel and said second web material is unwound from the second reel. Moreover, the head of the second web material advances resting on the first web material toward a splicing device.

Further advantageous features and embodiments of the unwinder and of the method according to the present invention are described in greater detail hereinafter and in the appended claims, which form an integral part of the present description.

BRIEF DESCRIPTION OF THE DRAWINGS

The invention will be better understood by following the description and accompanying drawing, which shows a non-limiting practical embodiment of the unit according to the invention. More in particular, in the drawing.

DETAILED DESCRIPTION OF ONE EMBODIMENT

Figure 7:
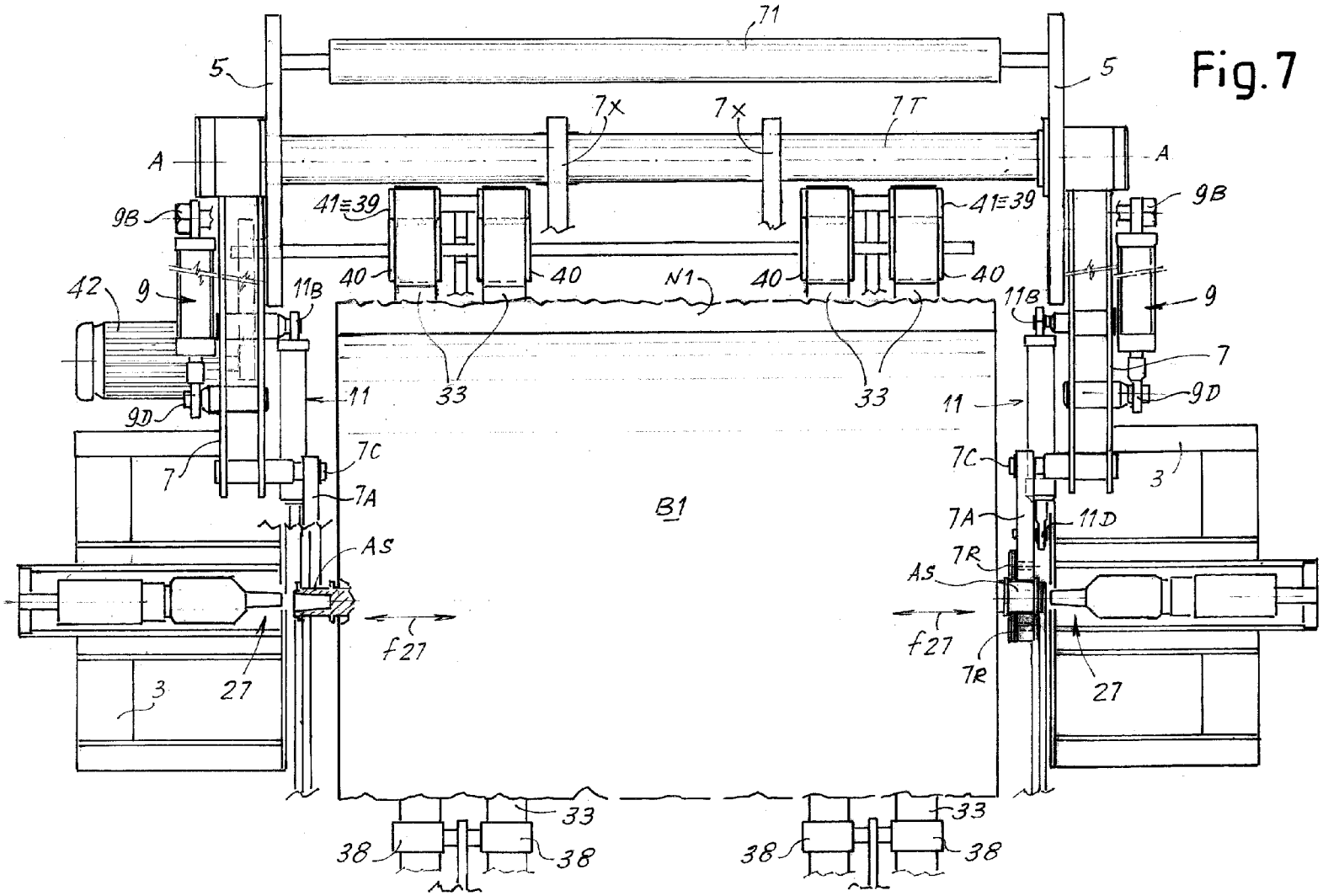
FIG. 7 shows a plan view according to VII-VII of FIG. 1.

With initial reference to FIGS. 1 and 7, there will first be described the main elements of an unwinder according to the invention in a possible embodiment. The unwinder, indicated as a whole with 1, comprises a load-bearing structure 3, on which means and devices are arranged that define: a stand-by position for a new reel standing by to replace a reel being unwound; a first unwinding position, in which a reel being unwound is positioned for a part of the unwinding cycle; a second unwinding position, in which the reel being unwound is transferred in the final step of delivering the web material wound thereon; and an unloading position, in which the winding rod, spindle or core, on which the reel has been wound, is transferred once the reel is empty or when it must be replaced for other reasons. In fact, it must be understood that a reel is normally utilized until it is empty and is replaced when empty. A reel is normally intended as empty when the web material remaining around the winding core is very wrinkled and can no longer be used. In fact, it is known that when forming of paper mill reels the innermost part of the reel, i.e. the first wound turns, have winding defects. This part of the web material is not used, remains wound around the core of the reel to be replaced and if necessary can be recycled. It must also be considered that there may be situations in which it is necessary to replace the reel before it is empty, i.e. before having reached the part of the web material to be discarded, as is known to those skilled in the art. The replacement cycle is substantially the same in the two cases and hereinafter, for the sake of simplicity, reference will always be made to replacement of an empty reel, it being understood that "empty" must be intended not only as a reel on which there is no longer an adequate quantity of usable web material, but more broadly also a reel, for which the unwinding cycle has been definitively or temporarily completed.

In the illustrated embodiment the structure 3 comprises uprights 5 on which pivoting arms 7 are pivoted about an axis A-A, which arms can perform a reciprocating rotation movement, i.e. a pivoting movement, according to the double arrow f7. In FIGS. 1 to 6 a single arm 7 is shown, but it must be understood that there are actually two arms arranged symmetrically at the two sides of the machine to engage, at opposite ends, a rod of a new reel standing by. In general, winding rod can be intended as the tubular winding core (usually made of cardboard, plastic, aluminum or other suitable material) equipped with end sleeves provided for pick-up of the core by tailstocks and other members of the unwinder, described hereinafter.

The movement according to the double arrow f7 is imparted by an actuator, for example a piston-cylinder actuator 9, the cylinder 9A of which is fastened in 9B to the load-bearing structure 3, and the rod 9C of which is pivoted at 9D to the respective pivoting arm 7. In some embodiments two distinct piston-cylinder actuators 9 can be provided, one for each arm 7, although it would also be possible to use a single actuator and if necessary a torsion bar to transmit movement from one to the other of the two pivoting arms 7. Instead of piston-cylinder actuators it would be possible to use actuators of another type, for example electric motors, hydraulic motors or the like.

Each pivoting arm 7 has an end 7A defining a seat 7B to house the respective end of a standing-by reel B2. Each seat 7B has wheels 7R on which the ends of the winding rods AS of the standing-by reels rest, so as to allow rotation of the reel supported in the seats 7B, for the purposes that will be explained hereinafter.

The end 7A of each arm is advantageously pivoted at 7C to the respective pivoting arm 7. The pivoting movement according to the double arrow f7A can be imparted to each end 7A of each pivoting arm 7 by a respective actuator, for example a piston-cylinder actuator 11, the cylinder 11A of which is pivoted at 11B to the respective pivoting arm 7, while the rod 11C is pivoted at 11D to the corresponding end 7A of the respective arm 7.

The pivoting arms 7 with the ends 7A and the related actuators form a transfer device, for transferring reels from a stand-by position to a first unwinding position, as will be described hereinafter.

Figures 1, 1A:
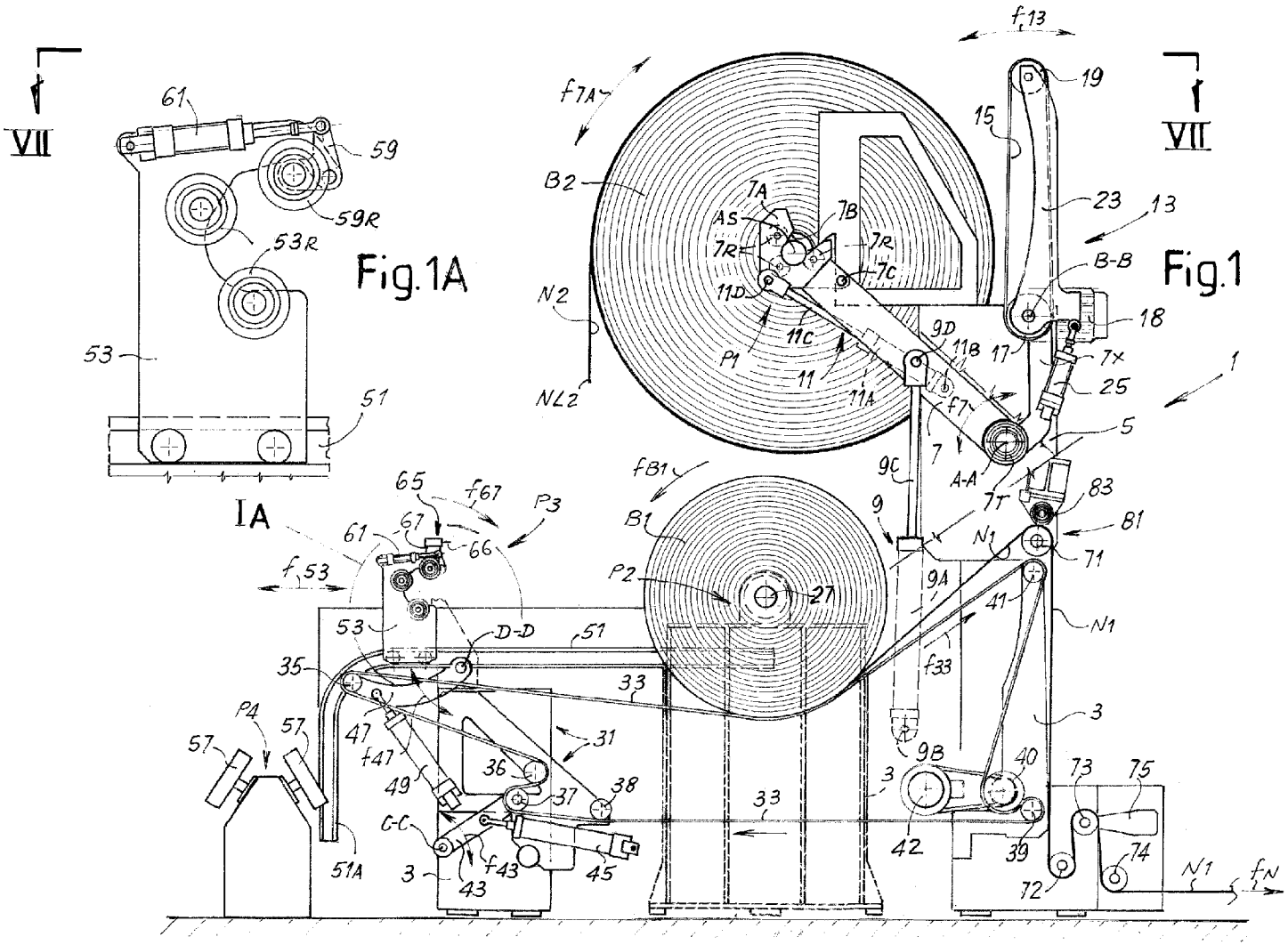
FIGS. 1 to 6 show an operating sequence of an unwinder according to the invention, also comprising the step of replacing an empty reel with a new reel, in a side view and partial section of an unwinder according to a possible embodiment.
FIG. 1A shows an enlargement of one of the carriages forming the transfer member of the reels from the first unwinding position to the second unwinding position and from this to the unloading position.

In the lifted position, shown in FIG. 1, the pivoting arms 7 with the end 7A and the respective seats 7B define a stand-by position for the reel B2. In the embodiment illustrated, the two arms 7 are connected by a torsion bar 7T. The torsion bar 7T guarantees synchronous movement of the two pivoting arms 7. Moreover, in the example illustrated (see FIG. 7) the torsion bar is also used to support a first unwinding member 13 arranged in an intermediate position between the two arms 7. In this embodiment the first unwinding member 13 comprises an endless flexible element 15, for example formed by one or more belts parallel to one another and guided around a first motorized roller 17 and around a second idle roller 19. Each roller 17 and 19 can actually be constituted by several coaxial rollers or pulleys, for example one for each belt forming the unwinding member 13. Hereinafter, for the sake of brevity, reference will always be made to "rollers" 17, 19. The roller 17 can be motorized, for example by means of an electric motor 18. The roller 19 is mounted on pivoting arms 23 pivoted about an axis B-B so as to pivot according to the double arrow f13. In FIGS. 1 to 6 only one pivoting arm 23 is shown, but it must be understood that preferably two arms 23 are provided, arranged side by side. The pivot axis B-B of the arms 23 is supported by extensions 7X torsionally constrained to the torsion bar 7T and extending therefrom in an intermediate position between the pivoting arms 7 (see FIG. 7), in such a manner that when the arms 7 pivot according to f7, the pivot axis B-B of the arms 23 follows the rotation movement about the axis A-A performed by the pivoting arms 7, for the purposes that will be apparent hereinafter.

The pivoting movement according to f13 is imparted by means of an actuator 25 or a pair of actuators 25, one for each arm 23. The actuator or actuators 25 can, for example, be piston-cylinder actuators. Alternatively, there can be provided a single actuator 25 with a torsion bar that transmits movement from one to the other of the two arms 23.

Approximately below the stand-by position, indicated with P1 in FIG. 1, a first unwinding position is defined and indicated as a whole with P2, in which a first reel B1 being unwound (FIG. 1) is located. The first unwinding position P2 is defined by a pair of idle tailstocks 27, also shown in FIG. 7. The tailstocks 27 are provided with an axial movement to move toward and away from one another according to f27 to engage the opposed ends of a winding rod AS of the reel B1, which is located in the unwinding position and to release said reel allowing transfer thereof toward a second unwinding position, indicated as a whole with P3. The second unwinding position P3 is located, with respect to the first unwinding position P2, on the side opposite to the outlet of the web material N1 from the unwinder 1 towards the downstream station (not shown). In other words: the first unwinding position P2 is located between the outlet of the web material from the unwinder and the second unwinding position P3.

To maintain the reel B1 in rotation when it is located in the first unwinding position P2, a second unwinding member, indicated as a whole with 31, is provided. In the illustrated embodiment the second unwinding member 31 comprises at least one endless flexible element 33, which forms a peripheral unwinding element, i.e. which imparts to the reel B1 the rotation motion by means of friction contact with the lateral cylindrical surface of the reel. In some embodiments the endless flexible element 33 can be formed by an endless belt. Preferably, however, said endless flexible element 33 is formed by a plurality of parallel belts all guided around the identical path defined by guide rollers or series of guide pulleys, at least one of which is motorized and the others being preferably idle. In the illustrated embodiment, the endless flexible element 33 extends from the outlet area of the web material N1 to the second unwinding position P3. In some embodiments, in addition to the endless flexible member 33 that extends for the whole of the aforesaid length, auxiliary endless flexible members of lesser extension can be provided, for example which extend only in the area of the first unwinding position P2, and which move at the same speed as the endless flexible member 33. This is because, as will be apparent hereinafter, the reel in position P2 is larger (at least in the first unwinding step) and requires a drag torque, which is greater than the torque that is sufficient to maintain in rotation the almost empty reel located in the second unwinding position P3.

In the illustrated embodiment, the endless belts that form the endless flexible element 33 are guided around rollers 35, 36, 37, 38, 39, 40, 41. Just as for the unwinding member 23, also for the endless flexible element 33 the guide or return rollers can each be constituted by a plurality of coaxial rollers or pulleys. Hereinafter, for the sake of brevity, reference will always be made to guide or return rollers. At least one of the guide rollers is motorized, for example the guide roller 40 can be motorized. The motor of the roller 40 is schematically indicated with 42 (see in particular FIG. 7). In the illustrated embodiment all the rollers 35-41 are supported with axes, which are stationary with respect to the structure 3, with the exception of the rollers 37 and 35.

In fact, the roller 37 or each roller 37 is supported by a movable arm 43, or by a pair of movable arms 43 pivoted about an axis C-C to a fixed part of the load-bearing structure 3. An actuator 45, for example a piston-cylinder actuator, is used to maintain the tension of the endless flexible element approximately constant, imparting a controlled pivoting movement according to the double arrow f43 to the pivoting arm 43.

Vice versa, the guide roller 35 is supported by a pivoting arm 47 pivoted to the fixed structure about an axis D-D. The pivoting movement according to the double arrow f47 of the arm 47 is imparted by an actuator, for example a piston-cylinder actuator 49 so as to modify the position of the guide roller 35 as a function of the step of the unwinding cycle, as will be described below with reference to the sequence of FIGS. 1 to 6.

Between the first unwinding position P2 and the second unwinding position P3 a pair of guides 51 extends, which are carried by the structure 3 and along which a transfer member is guided to transfer the reels. In the illustrated example the transfer member comprises a pair of opposed carriages 53, movable along the two lateral side members of the unwinder (see also FIG. 7). The movement of the carriages 53 according to the double arrow f53 along the guides 51 can be imparted, for example, by an electric motor (not shown) on each carriage 53, which places in rotation a pinion meshing with a respective rack (neither of which is shown in the drawing, for the sake of simplicity), extending along the one, the other or both guides 51, or in another suitable manner. In other embodiments, a single fixed motor, connected to the two carriages 53 by means of chains guided along a path that follows the guides 51, can be provided.

The guides 51 extend beyond the second unwinding position P3 forming a downward curve and continuing to form a descending section 51A, which terminates at an unloading position P4. In the unloading position P4 a pair of conveyors 57 are provided, for receiving and removing the empty rods of the reels coming from the second unwinding position P3.

The structure of the carriages 53 is shown in greater detail in FIG. 1A, which illustrates an enlargement of one of the two carriages, limited to its main elements.

In some embodiments each carriage 53 has a locking element 59 operated by an actuator 61, for example a piston-cylinder actuator, to lock on each carriage 53 the respective end of a rod of the almost empty reel B1 to transfer it from the first unwinding position P2 to the second unwinding position P3 and from this to the unloading position P4, as will be described in greater detail hereinafter. In practice, the locking element 59 is double, one on each carriage 53, to engage the two opposite ends of the rod AS of the reel. Each locking member 59 is provided with an idle wheel 59R. The respective carriage 53 is in turn provided with two idle wheels 53R. The wheels 53R and 59R are arranged in such a manner that, when the end of the winding rod AS is engaged with the respective carriage 53, it is retained between the wheels 53R, 53R, 59R and can rotate, for the purposes described hereinafter, about its axis.

In the embodiment illustrated, with the second unwinding position P3 a cutting member 65 is associated, comprising, for example, a transverse blade 66 supported by pivoting arms 67 which are operated to move according to the double arrow f67 by an actuator, not shown, for example a piston-cylinder actuator or the like.

The path of the web material N1 being unwound from the reel B1 located in the first unwinding position P2 is defined, by the endless flexible element 33 of the unwinding member 31, as well as by a guide roller 71, located lower than the pivot axis A-A of the pivoting arms 7. The path of the web material N1 then extends from the roller 71 downward to a set of three guide rollers 72, 73 and 74, in substance defining the outlet of the unwinder. One or more of these rollers can be mounted in such a manner as to translate with respect to the others to detect fluctuations in the tension of the web material N1 by means of an encoder, while the web material is unwound according to the arrow fN toward a converting station downstream of the unwinder 1, not shown, for example an embossing unit, a rewinder or the like. In other embodiments a load cell can be provided, which detects the reaction forces on the bearings of a guide roller of the web material N. In general, whatever the system for detecting fluctuation of the tension of the web material N, a signal generated by the detection system can be used to control the unwinding speed, in order to maintain the unwinding tension at the required value.

The guide roller 71 forms part of a splicing device 81, which comprises, in addition to the aforesaid guide roller 71, a series of ply-bonding wheels 83. The latter cooperate with the surface of the guide roller 71 when the tail end of the web material N1 coming from the reel B1 being unwound is to be spliced to the head end of the web material N2 wound on the reel B2 standing by.

As can be observed in the drawing, the first unwinding position P2 is located between the splicing device 81 and the second unwinding position P3 and the endless flexible element 33 of the second unwinding member 31 extends from the splicing device 81 up to the second unwinding position P3.

Operation of the unwinder 1 described in the foregoing is clear from the structure as illustrated above. FIGS. 1 *a* 6 show in detail an operating sequence, including the exchange step of an empty reel B1 with a new standing-by reel B2.

More in particular, in FIG. 1 the reel B1, in an intermediate step of its unwinding cycle, is rotating according to arrow fB1 (in counter-clockwise direction in the drawing) to deliver the web material N1 according to the arrow fN to the downstream station, not shown. The reel B2 is in the stand-by position P1. Advantageously, it has been arranged with the free head end NL2 partially unwound in a predetermined position.

In this step the reel B1 is maintained in rotation (arrow fB1) by the second unwinding member 31 and more in particular by the endless flexible element 33 which moves according to the arrow f33 by means of the drive system associated with the guide roller 40, for example. The guide roller with movable axis 37 can be moved gradually to maintain the endless flexible element 33 in tension as the diameter of the reel B1 decreases as a result of unwinding of the web material N1.

Figure 2:
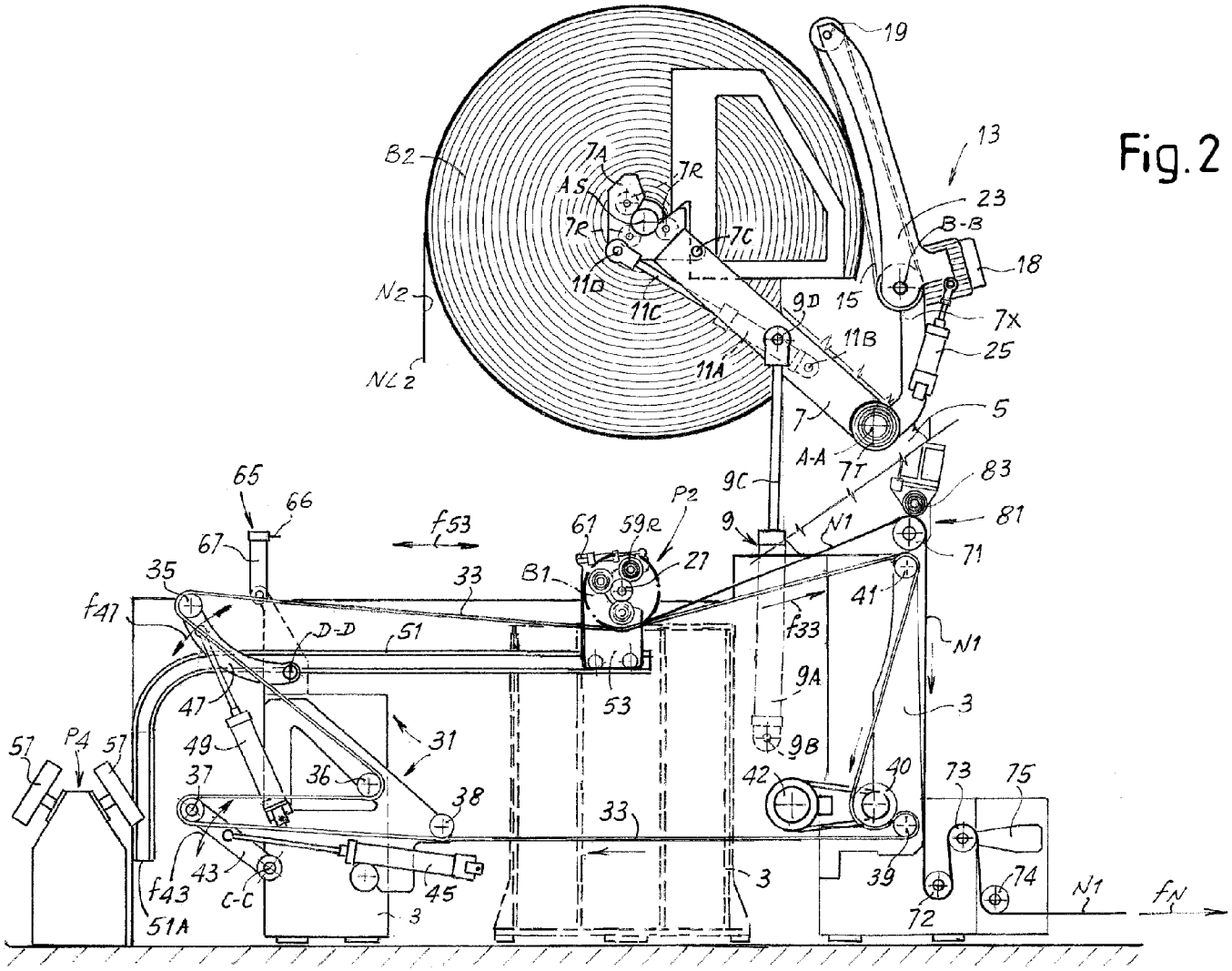

In FIG. 2 the reel B1 located in the first unwinding position P2 is almost empty and must be replaced with the new reel B2 located in the stand-by position P1. In FIG. 2 it can also be seen that the first unwinding member 13 has already been moved against the second reel B2 before starting the lowering movement of the pivoting arms 7. In this way, while the first unwinding member 13 is statioanry, it acts as a brake.

To transfer the reel B1 from the first unwinding position P2 to the second unwinding position P3 the carriages 53 are moved along the guides 51, until they are against the winding rod of the reel B1 in the first unwinding position P2. By means of the locking member 59 provided on each carriage 53 the ends of the winding rod AS of the reel B1, projecting from the reel B1, are engaged with the carriages 53.

Moreover, the guide roller 35 is lifted by means of upwardly pivoting the pair of arms 47 by means of the piston-cylinder actuators 49, until the guide roller 35 is taken to a position higher than the guides 51, on which the carriages 53 move. This modifies the path of the endless flexible element 33, the upper branch of which moves upward. In actual fact, the lifting movement of the guide roller 35 can be gradual and used, if necessary in combination with the aforesaid gradual movement of the guide roller 37, to offset the decrease in diameter of the reel B1 during unwinding of the web material N1.

Figure 3:
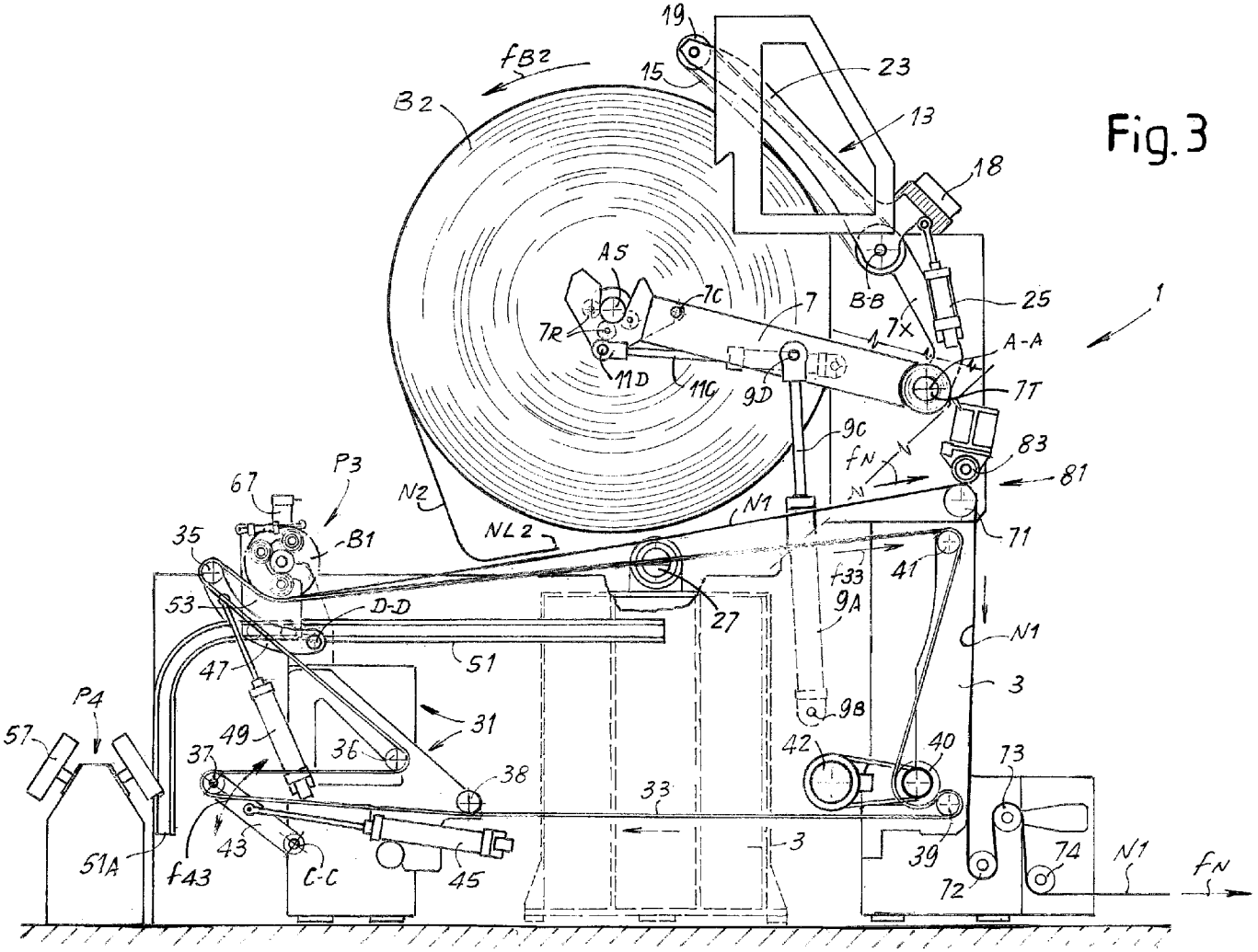

FIG. 3 shows the subsequent step, in which the carriages 53 forming the transfer member have transferred the reel B1 from the first unwinding position P2 to the second unwinding position P3. To perform this movement, the tailstocks 27 are first released (arrow f27, FIG. 7) from the winding rod AS of the reel B1, after said rod has been engaged with the carriages 53 forming the transfer member of the reel between the positions P2, P3 and P4. Due to the idle wheels 53R, 59R of the two carriages 53, the reel B1 can continue to rotate about its axis to unwind the web material N.

Due to the lifting of the guide roller 35 in the position of FIG. 3, the endless flexible element 33 of the second unwinding member 31 remains in contact with the reel B1 and extends for a certain angle around it also when said reel B1 is located in the second unwinding position P3.

In this way, the first reel B1 is maintained in constant rotation while it is in the first unwinding position P2, during transfer from the first unwinding position P2 to the second unwinding position P3, and also when it is located in the second unwinding position P3. The rotation speed and consequently the unwinding speed of the web material N1 can be decreased before starting transfer or during transfer to the second unwinding station P3, or when the first reel B1 is located in the second unwinding position P3.

Once the reel B1 has been moved away from the first unwinding position P2 the lowering movement of the second reel B2 from the stand-by position P1 (FIG. 1) toward the first unwinding position P2 can start. This movement is obtained by pivoting the arms 7 by means of the actuators 9 as shown in FIG. 3. The rotation or pivot axis B-B of the arms 23 of the first unwinding member 13 follows the pivoting movement of the pivoting arms 7.

When the cycle to replace the first reel B1 with the second reel B2 must be started, the first unwinding member 13 is placed in rotation and gradually accelerated, to start rotation of the second reel B2 in the unwinding direction. The endless flexible element 15 of the first unwinding member 13 follows the lowering movement of the reel B2 being constrained with its axis B-B to the pivoting arms 7 by means of the extensions 7X and the torsion bar 7T. Therefore the endless flexible element 15 of the first unwinding member 13 remains in contact with the second reel B2 while the latter is lowered toward the first unwinding position P2. Acceleration of the rotary movement of the second reel B2 is performed in a manner synchronized with the lowering movement of the reel B2.

In this step, due to the start of rotation (in counter-clockwise direction in the figure) according to the arrow fB2 of the second reel B2 caused by the first unwinding member 13, the head or end portion NL2 of the web material N2 starts to be unwound and rests on the first web material N1, which continues to be fed according to the arrow fN as a result of rotation of the reel B1, which is located in the second unwinding position P3 and is maintained in rotation by the second unwinding member 31.

As can be observed in FIG. 3, in this step the head portion of the web material N2 being unwound from the reel B2 advances supported by the first web material N1 together with the latter toward the splicing device 81.

Figure 4:
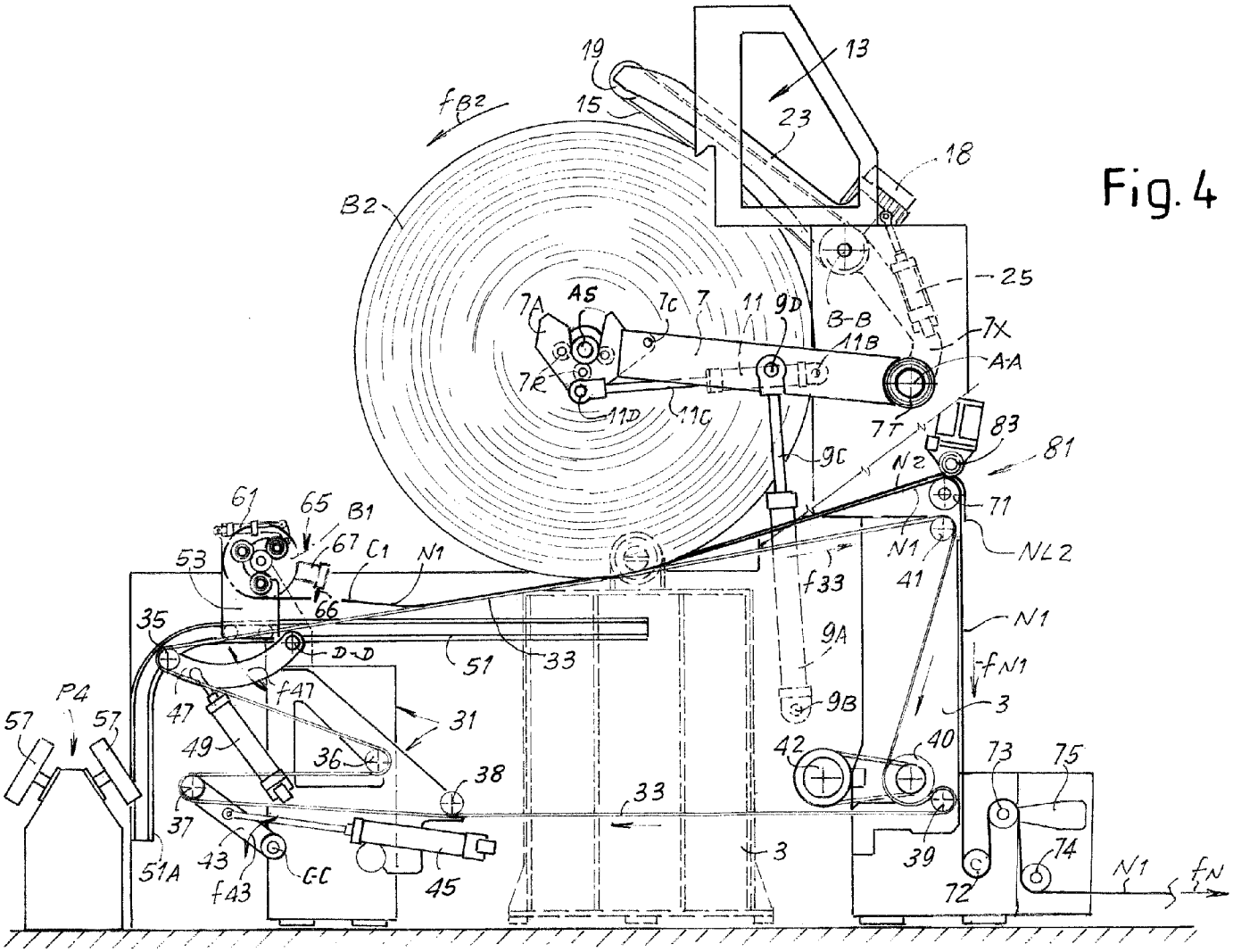

FIG. 4 shows the subsequent step, in which the second reel B2, continuing to be lowered and being maintained in rotation by the first unwinding member 13, comes into contact with the web material N1 and starts to press against the unwinding member 31 and more precisely against the upper branch of the endless flexible element 33. The head of the web material N2 being unwound from the reel B2 is spliced by the splicing device 81 to the final part of the web material N1, which continues to advance as a result of the movement of the endless flexible element 33. The cutting member 65 has cut the web material N1 coming from the reel B1, generating the tail Cl of the web material N1 and thus allowing the reel B1 to be moved away toward the unloading position P4. The roller 35 is lowered to move the endless flexible element 33 away from the empty reel B1 and thus stop the effect of rotation of the empty reel B1, so that the web material wound on it is no longer delivered. Moreover, lowering of the roller 35 allows the path to be freed to move the reel B1 away from the second unwinding position P3 toward the unloading position P4.

Figure 5:
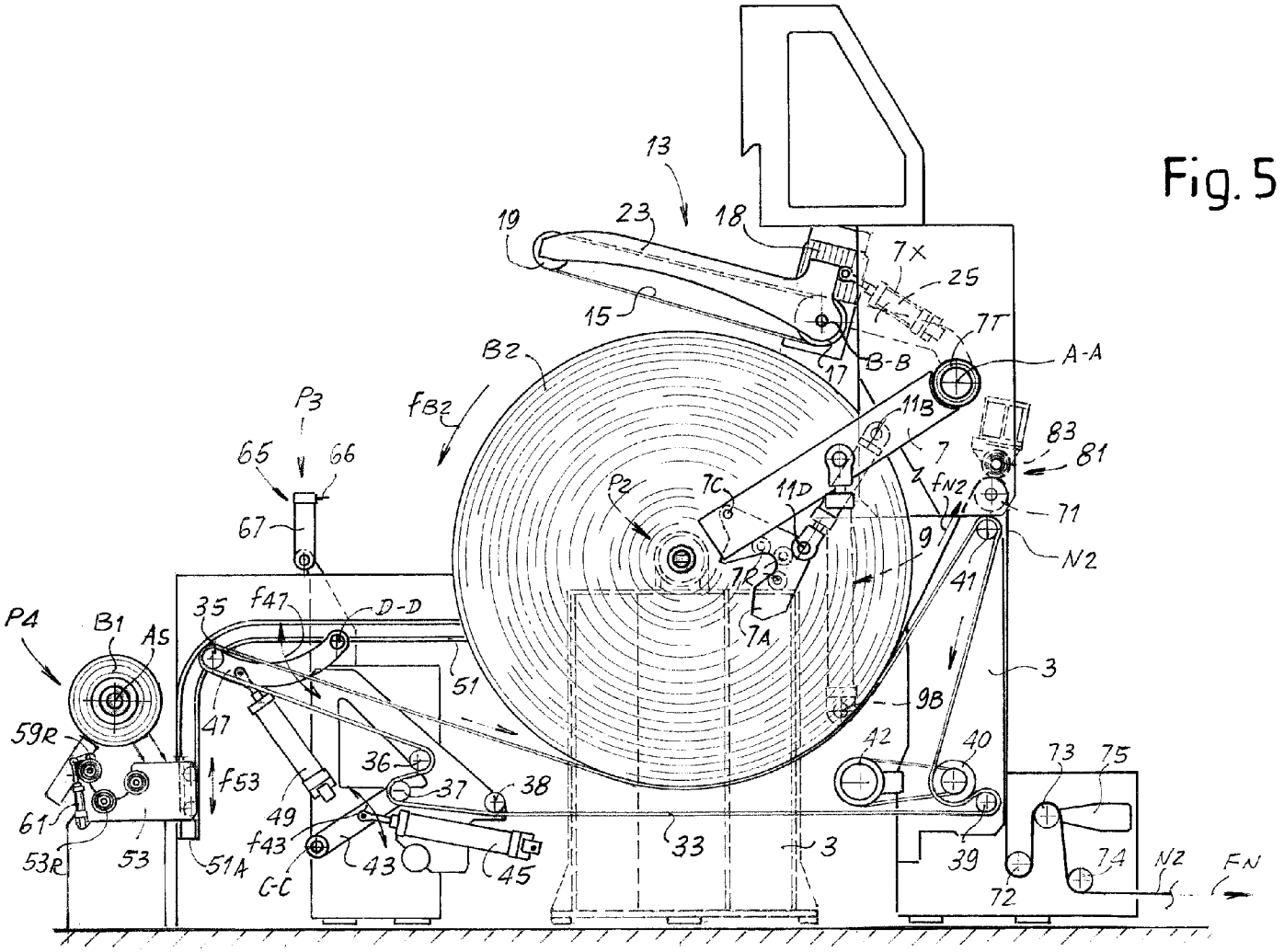

FIG. 5 shows the subsequent step, in which the carriages 53 have transferred the first empty reel B1 to the unloading position P4 while the new reel B2 has been released in the first unwinding position P2. The second reel B2 is released in the first unwinding position P2 as follows. The axis of the winding rod AS of the reel B2 is aligned with the tailstocks 27 by means of the movement of the pivoting arms 7. Once this position has been reached, the tailstocks 27 are moved toward one another (arrow f27) and engage in the hollow ends of the winding rod AS. To facilitate this pick-up operation, the tailstocks and the corresponding cavities of the winding rod AS preferably have a truncated-cone shaped portion. Once the second reel B2 has been engaged with the tailstocks 27, the ends 7A of the pivoting arms 7 are rotated by means of the actuators 11 to release the rod AS and the reel B2 and allow the arms 7 to be lifted again toward the stand-by position P1. Before transferring the reel B2 to the tailstocks 27, the reel B2 can in any case rotate and therefore deliver the web material N2, due to the wheels 7R provided in the seats 7B formed by the arms 7.

The first unwinding member 13 has disengaged from the second reel B2 which continues to rotate as a result of the movement of the endless flexible element 33 of the second unwinding member 31, so as to maintain the continuous feed of the web material N2, which has replaced the web material N1.

After finally reaching the second unwinding position P2 and being engaged by the tailstocks 27, the reel B2 can be accelerated to pass from a reduced rotation speed, at which the replacement step of the reels B1 and B2 was carried out, to the normal operating speed. If the normal operating speed is particularly low, it may also be possible to operate at the normal operating speed, also during the reels exchange or replacement step.

In any case, even if the speed at which replacement of the reels is performed is lower than the normal operating speed, it is still possible to feed the line downstream of the unwinder 1 continuously, if necessary temporarily decreasing the speed of the line.

Alternatively, an accumulator, for example a festoon accumulator, can be provided between the unwinder 1 and the line downstream. With respect to machines that require a complete stop of the unwinder during replacement of the empty reel with the new reel, an advantage is in any case obtained, as any accumulator required can be of smaller dimensions. The presence of an accumulator could also be used in order to perform exchange of the reel B1 with the reel B2 at a reduced speed, while maintaining the feed speed of the web material downstream of the accumulator at a higher speed, equal to the normal operating speed, or a speed intermediate between the normal operating speed and the unwinding speed of the reels B1, B2 during the exchange step.

Figure 6:
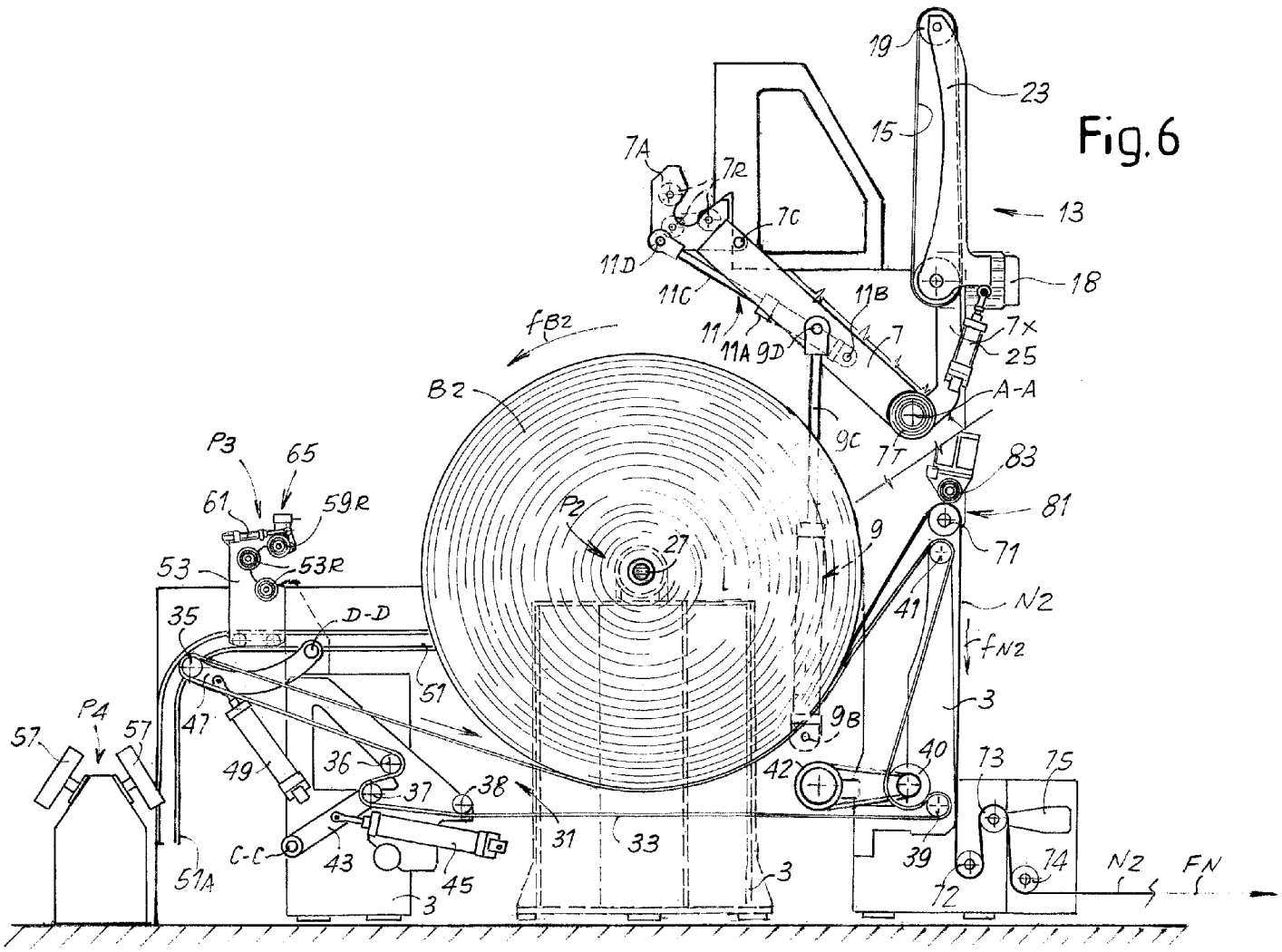

FIG. 6 shows the subsequent step, in which the empty reel B1 has been moved away from the unloading position P4 and the carriages 53 forming the transfer member have returned to their position along the approximately horizontal section of the guides 51. The arms 7 have been returned in position to receive, from an overhead traveling crane, not shown, a new reel to be kept in the stand-by position P1, while the reel B2, which is maintained in rotation and unwound by the second unwinding member 31, is located in the first unwinding position P2.

Figure 8:
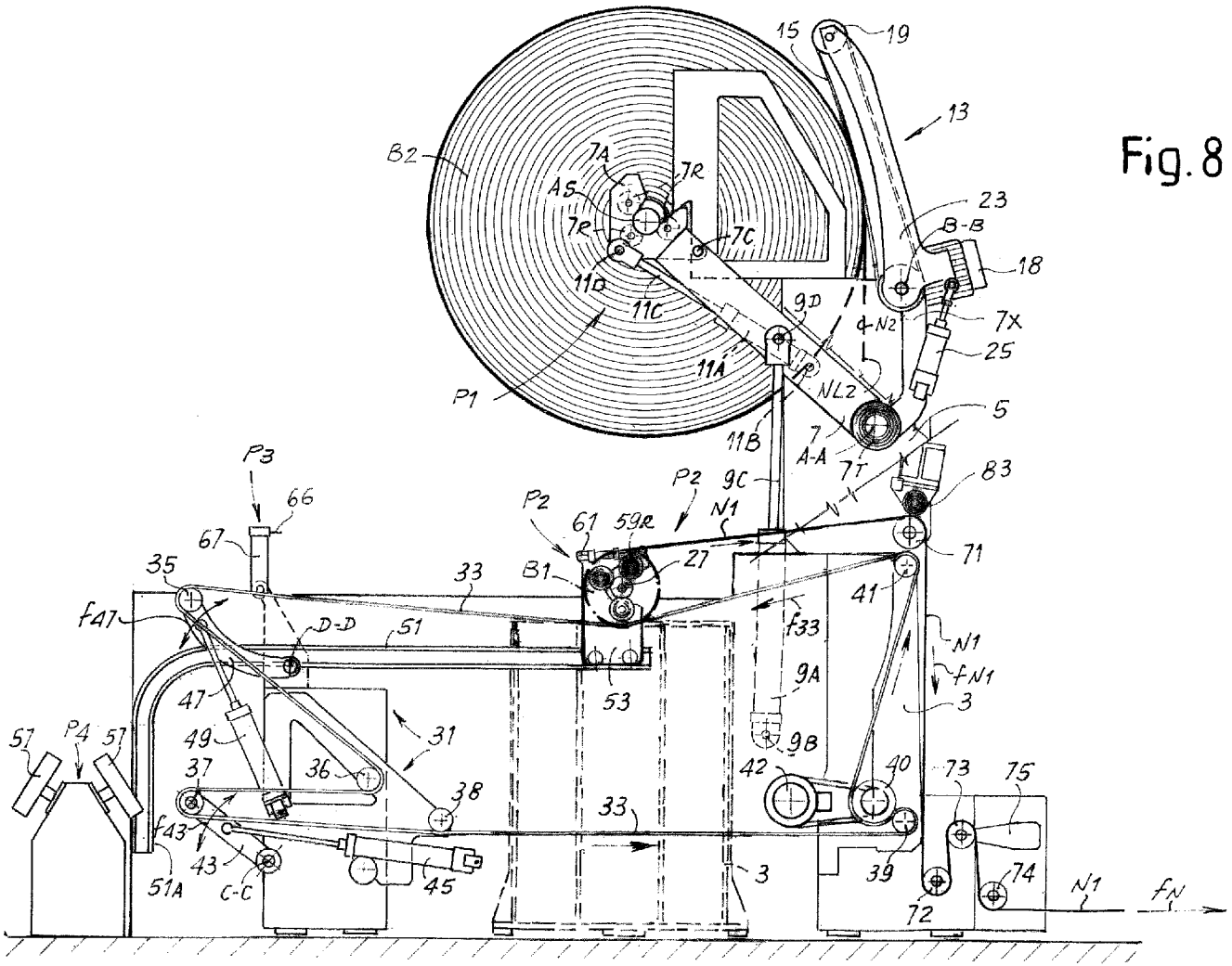
FIGS. 8 to 10 show a sequence of replacing an empty reel with a new reel in a second embodiment of the unwinding cycle.
Figure 9:
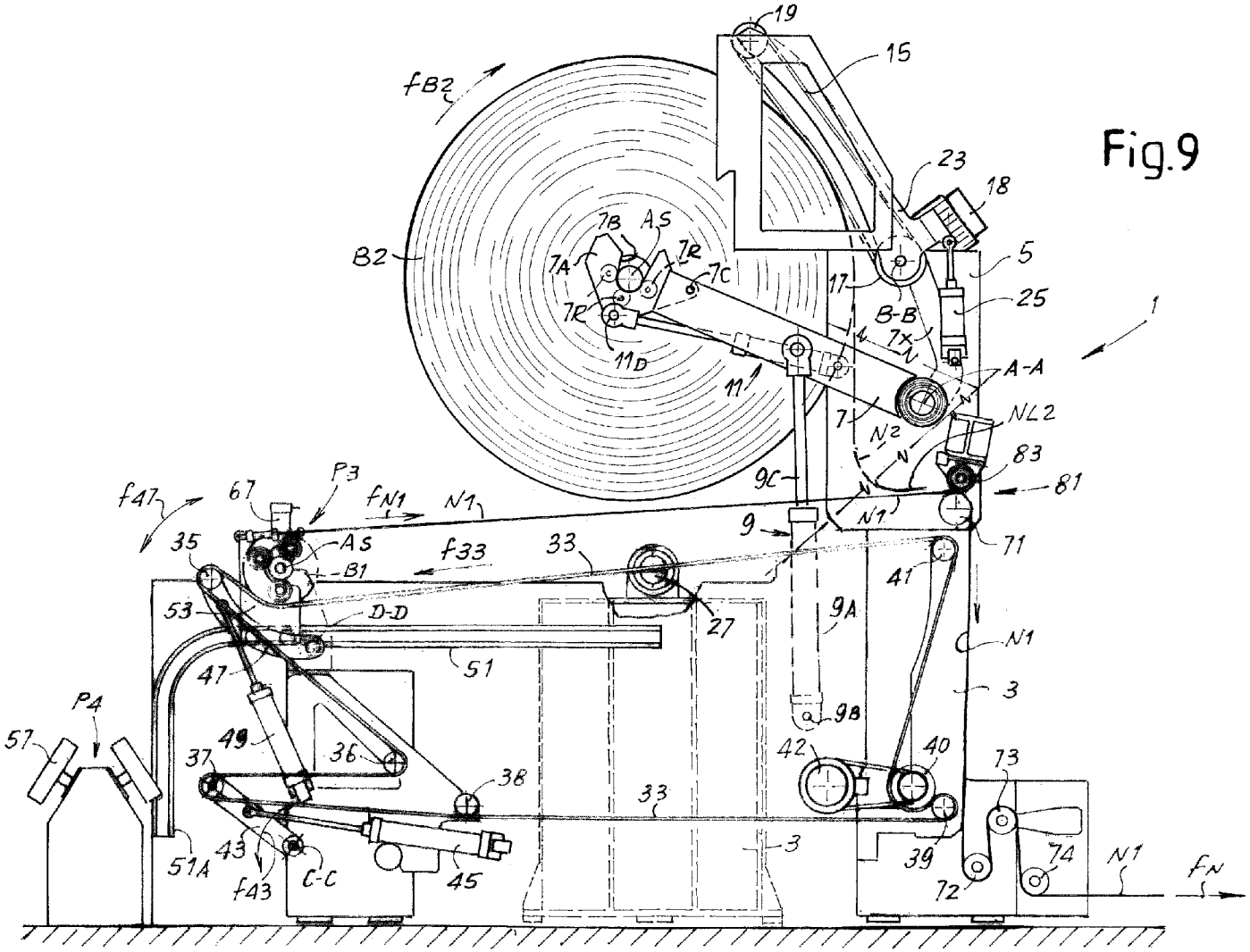
Figure 10:
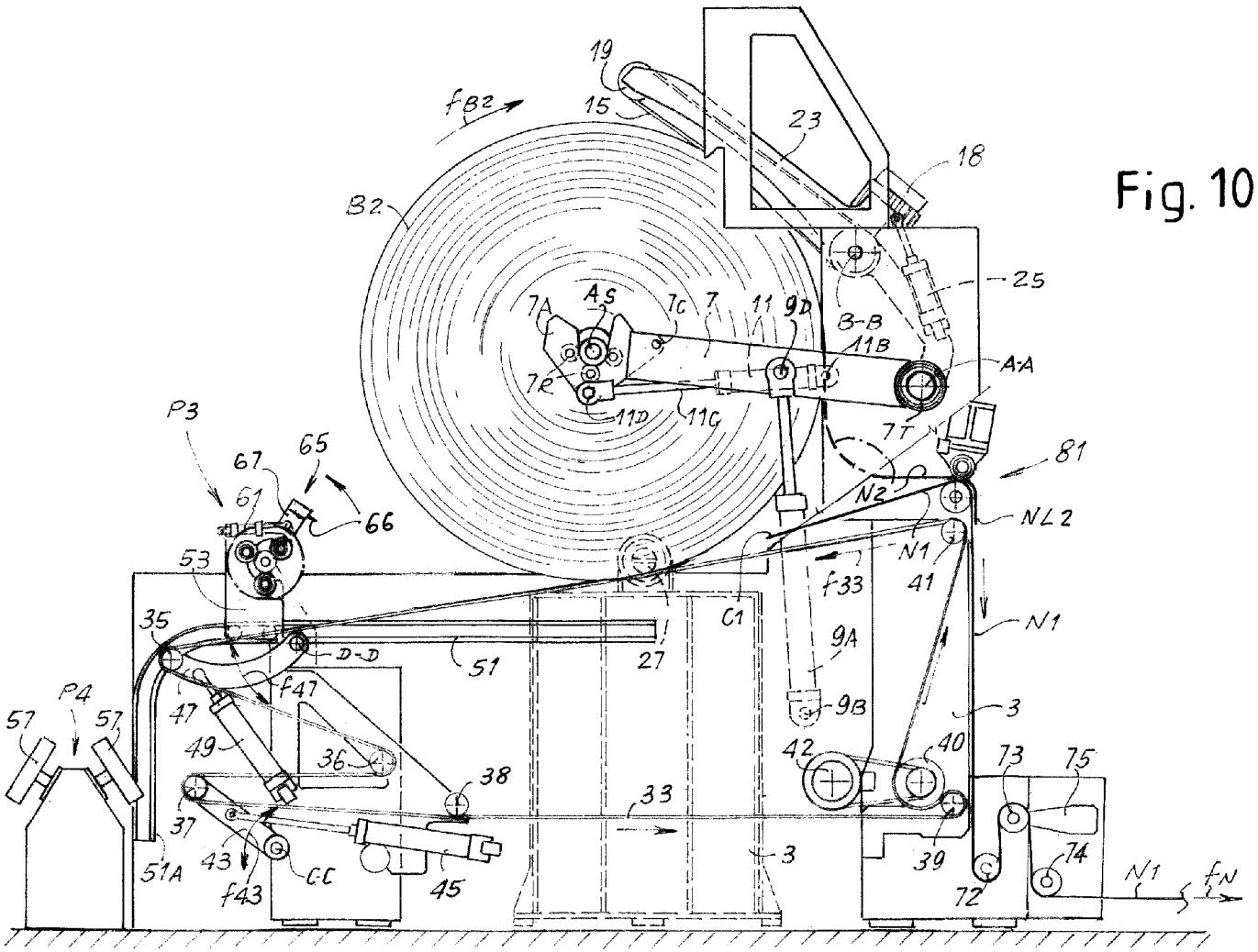

FIGS. 8, 9 and 10 show equivalent steps to those of FIGS. 2, 3 and 4 described above in the case in which the reels B1 and B2 must be unwound with a rotation in opposite direction with respect to that shown in the sequence of FIGS. 1 to 6, rotating the unwinding members 13 and 31 in opposite direction. The structure of the unwinder is identical. The unwinding steps are substantially the same, with appropriate adaptations, including the fact that contact between the reel B2 and the endless flexible element 33 takes place after the tail of the web material N1 has passed downstream of the contact point of the reel B2 with said endless flexible element 33.

FIGS. 8, 9 and 10 show that the unwinding device is also capable of handling these reels with a sequence substantially equivalent to the one described previously. Therefore, the unwinder 1 has the further advantage, with respect to prior art unwinders, of being able to unwind the reels without distinction in one direction or in the other, simply by reversing the rotation movement of the unwinding members 13 and 31.

It is understood that the drawing shows just one example, provided merely as a practical demonstration of the invention, which can vary in its forms and arrangements, without however departing from the scope of the concept underlying the invention. Any reference numbers in the appended claims are provided to facilitate reading of the claims with reference to the description and to the drawing, and do not limit the scope of protection represented by the claims.

The invention claimed is:

1. An unwinder for unwinding reels of web material comprising: a first unwinding position, in which a first reel is positioned during at least a part of an unwinding cycle; a second unwinding position, to which said first reel is transferred when said first reel is to be replaced with a second reel; a stand-by position, in which said second reel is kept in stand-by; a first unwinding member associated with said stand-by position, adapted to start rotation of said second reel when the first reel is to be replaced with the second reel; a first transfer device adapted to move between the first unwinding position and the second unwinding position for transferring the first reel from the first unwinding position to the second unwinding position; and a second transfer device adapted to transfer the second reel from the stand-by position to the first unwinding position; wherein a second unwinding member, comprising at least one endless flexible element, extends from the first unwinding position to the second unwinding position, and is adapted to maintain the first reel in contact with said second unwinding member and in rotation by said second unwinding member in said first unwinding position, in said second unwinding position and while said first reel is transferred from said first unwinding position to said second unwinding position.

2. The unwinder as claimed in claim 1, wherein said stand-by position is above said first unwinding position.

3. The unwinder as claimed in claim 1, wherein said first unwinding position is located between the second unwinding position and an outlet of the web material from the unwinder.

4. The unwinder as claimed in claim 1, wherein said second unwinding member is adapted to modify a path of the at least one endless flexible element as a function of position of the first reel with respect to the first unwinding position and to the second unwinding position.

5. The unwinder as claimed in claim 4, wherein said at least one endless flexible element is guided around a plurality of guide rollers, wherein at least one of said guide rollers has a movable axis, to modify the path of the at least one endless flexible element, and wherein at least one of said plurality of guide rollers is motorized.

6. The unwinder as claimed in claim 5, wherein at least two of said guide rollers have a movable axis to modify the path of the endless flexible element.

7. The unwinder as claimed in claim 5, wherein said at least one of said plurality of rollers with movable axis is adapted to move from a lower position to an upper position in said second unwinding position.

8. The unwinder as claimed in claim 1, wherein said endless flexible element extends from said first unwinding position to said second unwinding position and has an active branch which moves from said first unwinding position toward said second unwinding position or vice versa based on direction of rotation of the first reel.

9. The unwinder as claimed in claim 1, wherein said endless flexible element extends between the second unwinding position and a splicing device to splice the web material unwound from the first reel to the web material unwound from the second reel, the first unwinding position being located between the second unwinding position and said splicing device.

10. The unwinder as claimed in claim 1, wherein in said first unwinding position there are provided tailstocks adapted to axially engage said first reel and to release said first reel to allow movement thereof toward the second unwinding position.

11. The unwinder as claimed in claim 1, wherein said transfer member is adapted to move from the second unwinding position to an unloading position to release the first reel at an end of unwinding thereof.

12. The unwinder as claimed in claim 1, wherein associated with said second unwinding position is a cutting member adapted to cut the web material of said first reel at an end of unwinding.

13. The unwinder as claimed in claim 1, wherein said first unwinding member is a peripheral unwinding member.

14. The unwinder as claimed in claim 13, wherein said first unwinding member comprises an endless flexible element guided around at least two rollers with at least one of said at least two rollers being motorized.

15. The unwinder as claimed in claim 13, wherein said first unwinding member is supported movably to follow the second reel when said second reel is transferred from the stand-by position toward said first unwinding position.

16. The unwinder as claimed in claim 15, wherein said first unwinding member is supported by arms pivoting about an axis substantially parallel to an axis of the second reel and of the first reel.

17. The unwinder as claimed in claim 1, wherein said transfer device comprises arms pivoting about an axis substantially parallel to the second reel in said stand-by position.

18. The unwinder as claimed in claim 1, wherein said first unwinding member is constrained to said transfer device to follow movement of the second reel from the stand-by position to the first unwinding position.

19. An unwinder for unwinding reels of web material comprising: a first unwinding position, in which a first reel is positioned during at least a part of an unwinding cycle; a second unwinding position, to which said first reel is transferred when said first reel is to be replaced with a second reel; a stand-by position, in which said second reel is kept in stand-by; a first unwinding member associated with said stand-by position, adapted to start rotation of said second reel when the first reel is to be replaced with the second reel; a transfer member adapted to move between the first unwinding position and the second unwinding position for transferring the first reel from the first unwinding position to the second unwinding position; wherein a second unwinding member, comprising at least one endless flexible element, extends from the first unwinding position to the second unwinding position, and is adapted to maintain the first reel in contact with said second unwinding member and in rotation by said second unwinding member in said first unwinding position, in said second unwinding position and while said first reel is transferred from said first unwinding position to said second unwinding position; wherein said transfer member is adapted to move from the second unwinding position to an unloading position to release the first reel at an end of unwinding thereof, and wherein said at least one endless flexible element is guided around a plurality of guide rollers, wherein at least one of said plurality of guide rollers is motorized, and wherein said at least one of said plurality of guide rollers has a movable axis and is adapted to be lowered from an upper position to a lower position in said second unwinding position at the end of unwinding of said first reel providing passage of the transfer member from the second unwinding position to the unloading position.

20. A method for unwinding reels of web material and performing splicing between a tail of a first web material unwound from a first reel and a head of a second web material unwound from a second reel without stopping feed of the web material, comprising steps of:

positioning the first reel in a first unwinding position;

positioning the second reel in a stand-by position, in which a first unwinding member is arranged;

unwinding the first web material from said first reel by a second unwinding member;

before terminating unwinding of the first reel, transferring by a first transfer device said first reel from the first unwinding position toward a second unwinding position, maintaining said first reel in rotation by said second unwinding member and continuing to unwind said first web material;

placing the second reel in rotation and transferring by a second transfer device the second reel from the stand-by position toward the first unwinding position while the second web material starts to unwind from the second reel;

splicing a head of the second web material to a tail of the first web material.

21. The method as claimed in claim 20, wherein the head of the second web material is placed on the first web material, while said first web material continues to unwind from the first reel and said second web material is unwound from the second reel, and wherein said head of the second web material advances resting on the first web material toward a splicing device.

22. The method as claimed in claim 21, wherein said first web material is severed when the head of the second web material, following insertion thereof in said splicing device, together with the first web material.

* * * * *